United States Patent [19]

Brannan et al.

[11] 4,312,589

[45] Jan. 26, 1982

[54] CHARGE DENSITY CONTROL FOR AN ELECTROSTATIC COPIER

[75] Inventors: Robert C. Brannan, Boulder; Harvey R. Markham, Westminster; Ben A. Nilsson, Boulder, all of Colo.

[73] Assignee: International Business Machines Corporation, Armonk, N.Y.

[21] Appl. No.: 95,712

[22] Filed: Nov. 19, 1979

[51] Int. Cl.[3] ..... G03G 15/00

[52] U.S. Cl. ..... 355/14 CH; 355/3 CH; 355/77; 430/30

[58] Field of Search ..... 355/3 R, 3 CH, 14 R, 355/14 CH, 77, 133; 430/30

[56] References Cited

U.S. PATENT DOCUMENTS

| | | | |
|---|---|---|---|
| 2,956,487 | 10/1960 | Giaimo | 355/14 D |
| 3,976,374 | 8/1976 | Hickman | 355/14 |
| 4,032,227 | 6/1977 | Hubbard et al. | 355/14 D X |
| 4,105,324 | 8/1978 | Seil | 335/14 |

*Primary Examiner*—Fred L. Braun
*Attorney, Agent, or Firm*—Francis A. Sirr

[57] ABSTRACT

An electrophotographic copier having a toner concentration control apparatus which periodically effects a toner-patch test cycle during which the optical density of toner deposited on a photoconductor test area is measured, as by light reflectance. A time period of copier non-use, exceeding a preset time period, or a copier on/off operation, referred to as critical events, results in a transient mode of copier operation which includes reduction of photoconductor charge magnitude during the next subsequent use, independent of the extent of the prior copier use history. During such subsequent use, the toner-patch test cycle is operable to effect closed-loop control of changing the photoconductor's charge magnitude back to its nominal working value. More specifically, so long as the results of a toner-patch test cycle indicate an acceptable toner density, the photoconductor charge magnitude is maintained at a lower than working level. As the results of the toner-patch test cycle periodically indicate lower than acceptable toner density, as by a high light reflectance off the test patch, the photconductor's charge magnitude is periodically increased until finally the working charge magnitude is reached. The results of the toner-patch test cycle are operable to add toner to the copier's developer only when the photoconductor's charge magnitude has been increased to at or near the working magnitude.

10 Claims, 8 Drawing Figures

CHARGE DENSITY CONTROL FOR AN ELECTROSTATIC COPIER

DESCRIPTION

Technical Field

This invention relates to the xerographic devices, and specifically to the maintenance of uniform toner density on the copy sheets.

Related Patent Applications

The following copending and commonly assigned patent applications are usable as the toner concentration control apparatus of the present invention, and they are incorporated herein by reference.

U.S. Ser. No. 894,956 filed Apr. 10, 1978, now abandoned, discloses a test cycle quality control system for an electrophotographic machine wherein light reflectance measurements are compared from (1) a photoconductor toned test area and (2) a photoconductor cleaned reference area. The output of this system is used to check process-quality variables such as the developer's toner concentration, the photoconductor's image voltage, and the cleanliness of the photoconductor and/or the copier's optical system.

U.S. Ser. No. 894,955, now U.S. Pat. No. 4,183,657, filed Apr. 10, 1978 discloses a similar test cycle system. In this arrangement a single light sensor is used to sense light reflected from the toned test area and from the cleaned reference area. A single light source is sequentially energized at different current levels so as to produce equal excitation of the single light sensor, whether it is sensing reflectance from the reference area or from a correctly-toned test area.

U.S. Ser. No. 894,954, now U.S. Pat. No. 4,179,213, filed Apr. 10, 1978 discloses a similar test cycle system. In this arrangement, the absence of such equal excitation of the single light sensor results in adjustment of the copier's document illumination lamp energization, or adjustment of the copier's development electrode bias voltage, so as to maintain a substantially constant difference between the photoconductor's test image voltage and the copier's bias voltage.

U.S. Ser. No. 894,957, now U.S. Pat. No. 4,178,095, filed Apr. 10, 1978 discloses a similar test cycle system. In this arrangement a circuit is provided to indicate a condition such as photoconductor toner filming. Such a condition is sensed as abnormally low reflection from the photoconductor's cleaned reference area.

Background of the Invention

This invention relates to xerographic devices, and specifically to the maintenance of uniform copy quality. More specifically, certain critical events such as initial turn-on of the copier, or extended, uninterrupted, time periods of standby, followed by copier use, are known to provide excessively dense or black copies. As a result, the normally white copy background appears dirty, and/or hot roll fuser wraps may occur as the copy's dense toner layer fails to properly release from the surface of the hot roll and wraps thereabout. This invention controls the magnitude of photoconductor charge in a closed-loop manner to maintain copy quality, i.e. consistent blackness.

In document copier machines of the electrophotographic type, charged latent images are produced on a photoreceptive material. These images are then developed through the application of a developer mix of toner and carrier. Where the photoreceptive material is separate from the copy paper itself, a transfer of the developed toner image to the copy paper takes place, with subsequent fusing of the toner image to the paper. A common type of developer and mix currently in use in such machines is comprised of a magnetic brush developer, and a mix including carrier material such as magnetic beads which are coated with a black powdery substance called toner. It is the toner which is attracted to the photoconductor's charged latent image to develop that image, and it is the toner which is then transferred from the latent image to the copy paper (where the copy paper is separate from the photoconductor). Finally, it is the toner which is then fused to the copy paper to produce the finished copy, as by the use of a hot roll fuser wherein a heated roll directly pressure engages the toner.

It is apparent that toner is a supply item which must be periodically replenished in the copier's developer, since toner is carried out of the machine on the copy paper as a reproduced image. It is also apparent that the concentration of toner particles (i.e. the proportion of toner to carrier beads) in the developer mix is significant to good development of the latent image. Too light a toner concentration will result in too light a developed image, and too heavy a toner concentration will result in too dark, black, or dense a developed image.

Many schemes have been developed for maintaining the concentration of toner in a developer mix. The above-cited patent applications describe a toner concentration control scheme particularly useful in the present invention.

As above stated, in the conventional xerographic process the photoconductor is charged to a uniform voltage, for example −850 VDC. The photoconductor is then subjected to illumination reflected from an original document, to selectively dissipate the charge on the photoconductor surface. The document's white areas discharge the photoconductor to a low level, whereas the intelligence-bearing colored areas leave a relatively high charge, somewhat less than −850 VDC, on the photoconductor. Shades of grayness discharge the photoconductor to varying charge levels. In that manner the photoconductor is made to bear the latent electrostatic charge image of the original document.

Once a charged latent image is produced on the photoconductor it is subjected to a development technique wherein toner is placed upon the latent image. At the copier's development area, a development electrode bias voltage is usually provided in order to produce uniform toner distribution in the solid areas of the latent image. In magnetic-brush developers this is often accomplished by applying a bias voltage directly to the magnetic brush.

Toner density on the copy sheet has been observed to change, and specifically to become too black or dense upon the occurrence of certain critical events. This is undesirable in that uniform copy quality is not then maintained; in addition, a copy sheet which carries excessive toner may wrap about the hot toner engaging roller of a hot roll fuser.

U.S. Pat. No. 2,956,487 is an early teaching of a scheme whereby the toner density of a photoconductor's toned latent image is sensed, and a photoconductor's charge is controlled as a function of that density. This arrangement fails to respond to certain critical events, such as initial copier turn-on and long periods of standby, which can result in too dense a toned image.

U.S. Pat. No. 3,976,374 describes a xerographic device which renders at least one of a charging, exposing or developing station inoperative for a transient period at the start of a copy run, in order to allow all parts of the device, and specifically the paper feed, to reach an operative condition. This patent does not deal with excessive copy density after the occurrence of certain critical events, and requires a delay in operativeness of the copier prior to useful operation thereof.

U.S. Pat. No. 4,105,324 describes a xerographic device and changes the original document's illumination intensity, the photoconductor charge magnitude, and/or the development electrode's bias voltage as a function of the copier's rest/run history. More specifically, a capacitor is charged in a controlled manner when the copier is running, and discharges in a controlled manner when the copier is resting. This patent fails to dynamically sense the photoconductor's toned image to control the magnitude of photoconductor charge in a closed-loop fashion.

Summary of the Invention

The present invention involves the sensing of certain critical events, known to usually produce excessively dense copies for a time period thereafter, when in fact the developer's toner concentration has not changed, and to a means whereby the occurrence of such an event does not inhibit copier use, but rather institutes transient-use at a reduced photoconductor charge voltage. For example, in a system in which the photoconductor is charged to a nominal negative voltage, the magnitude of negative charge is reduced. Thereafter, a closed-loop controller responds to photoconductor toner density, and gradually increases photoconductor charge, while at the same time producing consistent copy quality, i.e. copies have the uniform toner density from one copy to the next. After a closed-loop-controlled, and transient time period, the controller reestablishes the nominal photoconductor charge.

More specifically, a toner concentration control device is used to view the photoconductor's toned image. As this image becomes less dense, during the above-mentioned transient time period following such a critical event, the photoconductor's charge is increased back toward nominal, to maintain a desired copy density. After nominal charge is reached, or shortly before, this toner concentration control device is thereafter once again enabled to maintain the desired density by controlling the developer's toner concentration.

The foregoing and other features of this invention, as well as its advantages and applications, will be apparent from the following detailed description of the preferred embodiments which are illustrated in the accompanying drawing.

DESCRIPTION OF THE PREFERRED EMOBODIMENT

Figure 1:
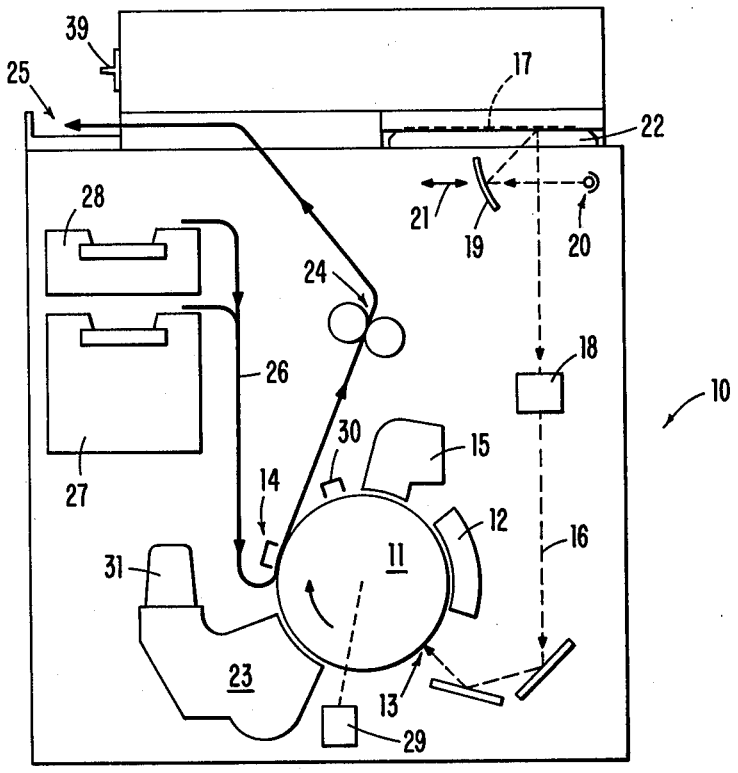
FIG. 1 is a schematic layout of an exemplary electrophotographic copier utilizing the present invention.

FIG. 1 shows an electrophotographic apparatus 10 incorporating the present invention.

Details of the electrophotographic process are well known to those skilled in the art, and form no part of this invention. It is to be understood that a variety of techniques exists for performing the various xerographic process functions.

With reference to FIG. 1, xerographic copier apparatus 10 includes a photoconductor drum 11 providing an image receiving photoconductor surface. A given area of drum 11 is sequentially rotated past a charging station 12, an exposure station 13, a development station 23, a transfer station 14 and a cleaning station 15. At the exposure station the uniform electrical charge which was applied to the photoconductor at the charging station is selectively dissipated. This charge dissipation is accomplished by reflected footprint of light 16.

Footprint 16 extends a substantial axial portion of drum 11 and is operable to discharge a working area of the photoconductor in accordance with the reflectance characteristic of a stationary original document 17. Document 17 is line-scanned by movable lens 18 and reflector 19. Light source 20 cooperates with reflector 19 to illuminate the original document with a footprint of light. This light footprint extends normal to scan direction 21. Document 17 is placed on document glass 22 with its length dimension normal to scan direction 21. The area of photoconductor drum 11 which is line-scanned by this reflected footprint is defined as the photoconductor's working area; i.e., it is the area which contains the reflected image to be reproduced, and which will coincide with a sheet of paper at transfer station 14.

The photoconductor's latent image is presented to development station 23 where black thermoplastic resin powder or toner is selectively deposited on only the charged image areas. Thereafter the developed image is transferred to a paper sheet, as by electrostatic force, at transfer station 14. The sheet is then passed through fixing station 24 in the form of a hot roll fuser, where heat temporarily liquifies the toner, causing it to adhere to the sheet and to form a permanent image thereon. The sheet is then delivered to exit pocket or tray 25 where it can be removed. Toner remaining on the photoconductor, as it leaves the transfer station, is removed at cleaning station 15 prior to recharging of the photoconductor. Paper is selectively supplied to path 26 from a primary bin 27 or a secondary bin 28 wherein stacks of cut sheets are stored with their length dimension oriented normal to the direction of sheet feed. These two bins allow the use of sheets of different length, and allow manual selection of a sheet length most nearly corresponding to the length of original document 17.

With reference to document glass 22 upon which original document 17 is placed, all original documents are left-front-corner referenced to a stationary reference corner indicia. The reflection optics, including lens 18, is operable to reflect this reference corner to the back of the clockwise rotating photoconductor drum 11.

Photoconductor drum 11 may be of the type wherein a flexible photoconductor web is carried on the rigid metallic surface of a drum. The photoconductor is stored in flexible strip form on supply and take-up rolls located within the drum's interior. The portion of the photoconductor extending between the two rolls encircles the drum and is active in the electrophotographic process. In order to change the active photoconductor portion, a length of the photoconductor is advanced from the supply roll to the take-up roll. The drum's surface includes an axially extending slot whereat the photoconductor enters and exits the drum's interior. This slot is closed by a seal strip. U.S. Pat. No. 3,588,242, issued to R. A. Berlier et al is an example of such a photoconductor drum structure.

Control of many of the various copy process means is achieved synchronously with movement of drum 11. A drum position transducer 29 provides a signal output to relay logic, discrete semiconductor logic, solid state logic or a microcomputer (none of which is shown) in order to achieve such copier control in a manner well known to those of skill in the art.

The xerographic device of FIG. 1 represents the IBM Series III Copier/Duplicator, and its Service Manual Form No. 241-5928-0, March 1976 is incorporated herein by reference to illustrate the background of the invention and the state of the art. This copier is capable of making two copies of the same original document in one revolution of drum 11.

A modification to this exemplary copier is the use of the toner concentration control arrangement of the above noted copending applications, namely, the use of reflectivity sensor 30 which sequentially samples the reflectance off a cleaned portion of photoconductor drum 11's working area, and then off a toned test patch within this working area. Sensor 30 incorporates within its housing light emitting diode (LED) 33 and photosensor 34 of above-mentioned U.S. Ser. No. 894,956, now abandoned. As disclosed in that application, when a toner concentration control cycle occurs, sometimes called a dummy cycle, and if the results indicate a need to add toner to developer 23, a signal (38 of FIG. 2) is sent to replenisher 31. This replenisher holds a supply of toner and now operates to dump a measured amount into developer 23 for use in the copy process.

As disclosed in the referenced copending applications, a charged photoconductor test stripe, parallel to the axis of drum 11, or in the alternative a smaller-area rectangular charged test patch (both of which are referred to herein as a test patch), is produced on the drum's working area before that area moves into developer 23 for toning. The density of toner placed on the test stripe or patch is a function of (1) the toner concentration within the developer, (2) the photoconductor's charge voltage level at the test patch, and (3) the triboelectric charge carried by the toner.

Figure 2:
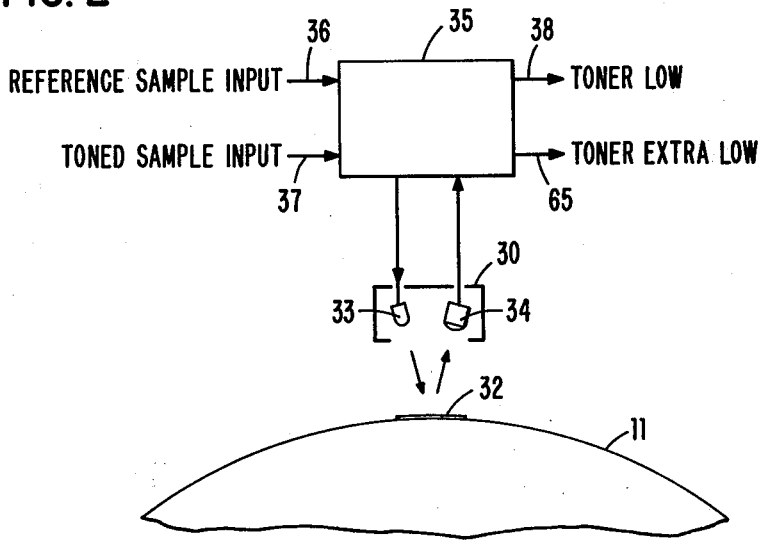
FIG. 2 is the toner concentration controller utilized in the copier of FIG. 1.
Figure 6:
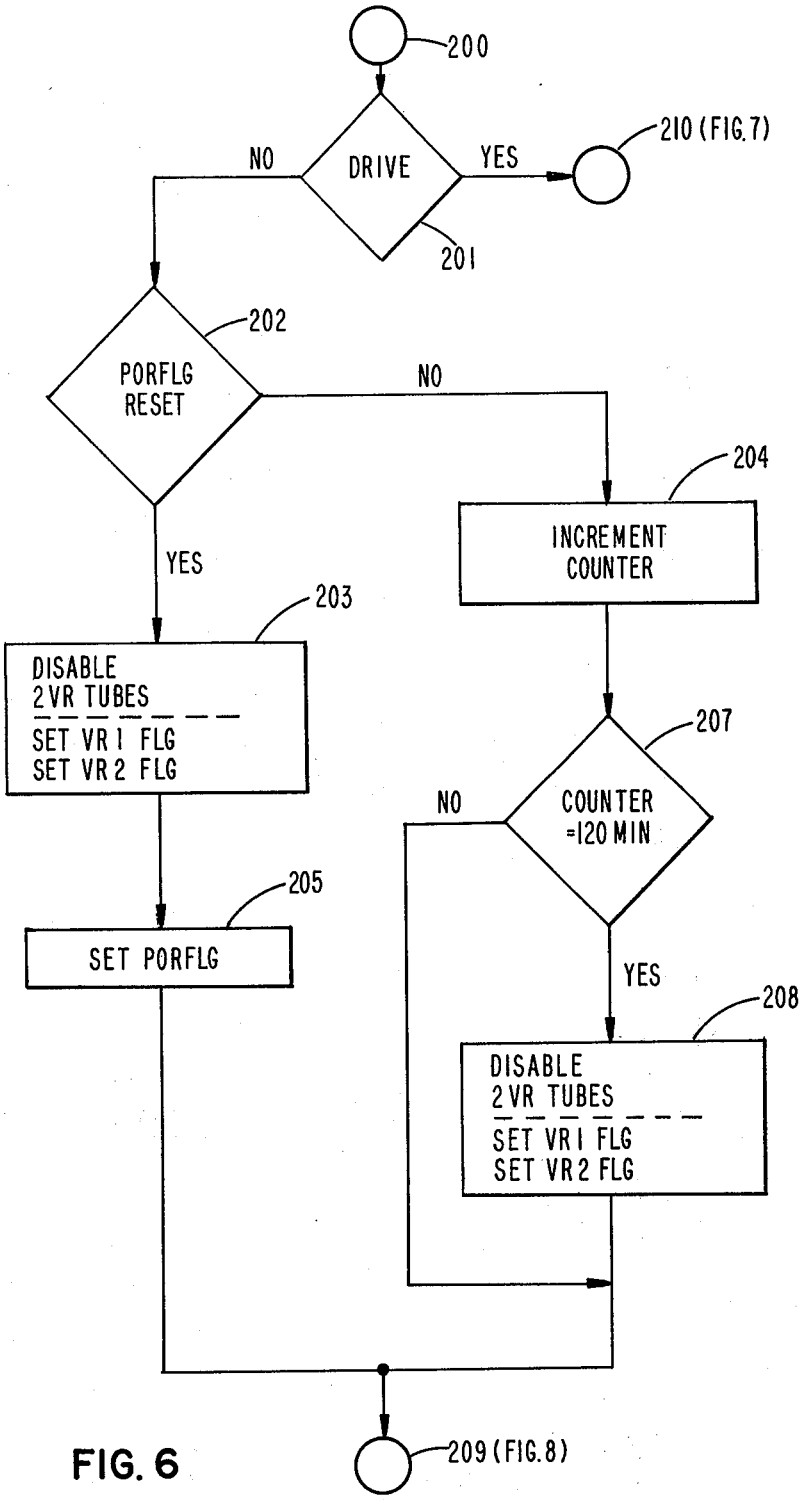

With reference to FIG. 2, network 35 is the arrangement of FIG. 6 of referenced copending application Ser. No. 894,956, now abandoned. As explained in that application, reference-sample-input line 36 and toned-sample-input line 37 operate to energize LED 33 synchronous with particular positions of drum 11 so as to cause photosensor 34 to detect the light reflected off a clean area of the photoconductor, and then off a toned test patch, such as patch 32. If the patch is of too low a toner density, the toner-low line 38 issues an active signal. As described in the referenced applications, excessively low toner density at patch 32 produces a signal on line 65.

The frequency at which the FIG. 2 arrangement is rendered operative during normal copier operation, to cause a dummy photoconductor cycle to be run (i.e. no copy is made), in order for a test patch to be formed, is not critical. It has been found desirable to run such a dummy cycle at the end of each copy request run, or after every n copies of a longer copy request run, where n may be 35.

In the present invention this same signal 38 is operable in response to the occurrence of a critical event which is likely to effect copy quality, to effect closed-loop control of the increasing of photoconductor charge, effected by charging station 12, causing the charge to be increased from a lower-than-nominal level to the nominal level in response to operation of a closed-loop control system. For example, charging station 12 may be a gridded corona, and photoconductor charge may be changed by changing the grid voltage of this corona.

A specific above-mentioned critical event, without limiting the present invention thereto, is a relatively long period of nonuse of the copier, for example, a period in excess of two hours. After such a nonuse period, the first copies issuing from the copier may be excessively toned, including excessively gray background areas which should be paper-white. This excessive toner not only contributes to degraded copy quality, but may also contaminate the inside of the copier with toner dust and/or cause the paper to wrap about the hot roll of fuser 24. It has also been found advantageous to interpret every copy turn-on (also called a copier off-to-on event), as by operation of on/off switch 39, as such a critical event.

This poor copy quality phenomenon is a transient condition; that is, the copy quality becomes acceptable after a number of copies have been made. The cause of this phenomenon is not known with a reasonable degree of certainty. However, it may be caused by the toner/carrier within developer 23 losing or altering its triboelectric charge.

The present invention can be implemented by any number of specific means, such as relays, discrete semiconductor logic, solid state logic or microcomputer.

Figure 3:
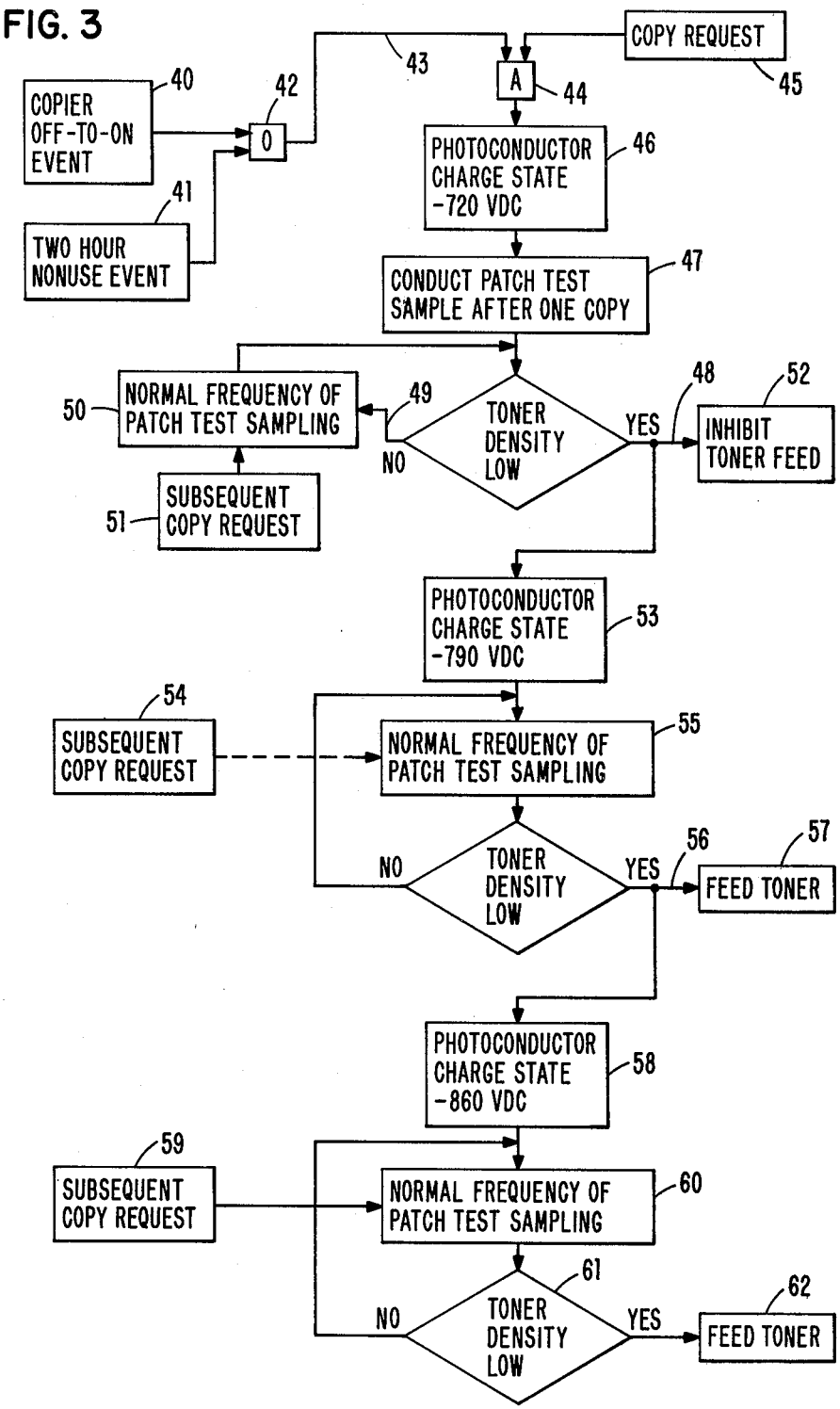
FIG. 3 is a flow chart disclosing the present invention.

The FIG. 3 showing of the present invention is believed to provide an enabling disclosure thereof to those skilled in the art. In this flow chart critical events 40 and 41, namely, the occurrence of a copier off-to-on event, as by turning on FIG. 1's switch 39, or the occurrence of a two-hour nonuse period as measured for example by a microcomputer implemented clock, are sensed by OR 42, thus, applying one enabling input 43 to AND 44. The next event to occur is the request to use the copier by an operator, namely event 45.

A copy run, of a copy-number-length selected by the operator, now begins with FIG. 1's charging station 12 controlled to charge photoconductor drum 11 to −720 VDC, event 46. The first copy of original document 17 is made. Thenext event to occur is the enabling of the FIG. 2 device to check toner concentration on test patch 32, event 47. The result of this test is either the presence of FIG. 2's signal 38 (or perhaps 65) indicating a low density of toner on patch 32 (event 48 of FIG. 3), or the absence of such a signal (event 49 of FIG. 3).

If the test patch is too dense, operation continues with a photoconductor charge of −720 VDC and the normal frequency of operation of the copier's toner concentration control network, event 50. This mode of operation also includes the possibility of subsequent copy requests at this state of photoconductor charge, event 51.

Note that operation of a xerographic process with a lowered photoconductor charge voltage will usually produce less dense toner on the photoconductor, but only if other process parameters remain the same. If, for example, the toner has lost a portion of its charge, the toner density may in fact be high.

Usually within a few copies, event 48 occurs. When it does, the presence of this first occurring toner-low signal 38, after one of events 40, 41, is not operative to feed toner from dispenser 31 into developer 23, as shown by event 52. What does occur, however, is that the photoconductor's charge state is immediately changed from −720 VDC to −790 VDC, as shown by event 53. Event 53 will occur whenever event 48 occurs. Subsequent copies are now produced at a photoconductor charge of −790 VDC. During these subsequent copies, which may include subsequent copy requests as shown by event 54, the copier's toner concentration control system operates in a normal fashion, as shown by 55. When such operation of the toner concentration control system generates a toner-low signal 38 (FIG. 2), event 56 occurs. As a result, toner is dispensed from dispenser 31 into developer 23, as shown by 57 of FIG. 3. In addition, the photoconductor's charge state is immediately changed to −860 VDC, as shown by 58. This is the copier's nominal or working charge state, i.e. the state at which the copier will continue to operate until one of the events 40, 41 again occurs. All subsequent copy requests 59 are produced at this state of photoconductor charge, absent an event 40, 41, and the toner concentration control system operates to feed toner as intended, as shown by 60, 61 and 62.

Figure 4:
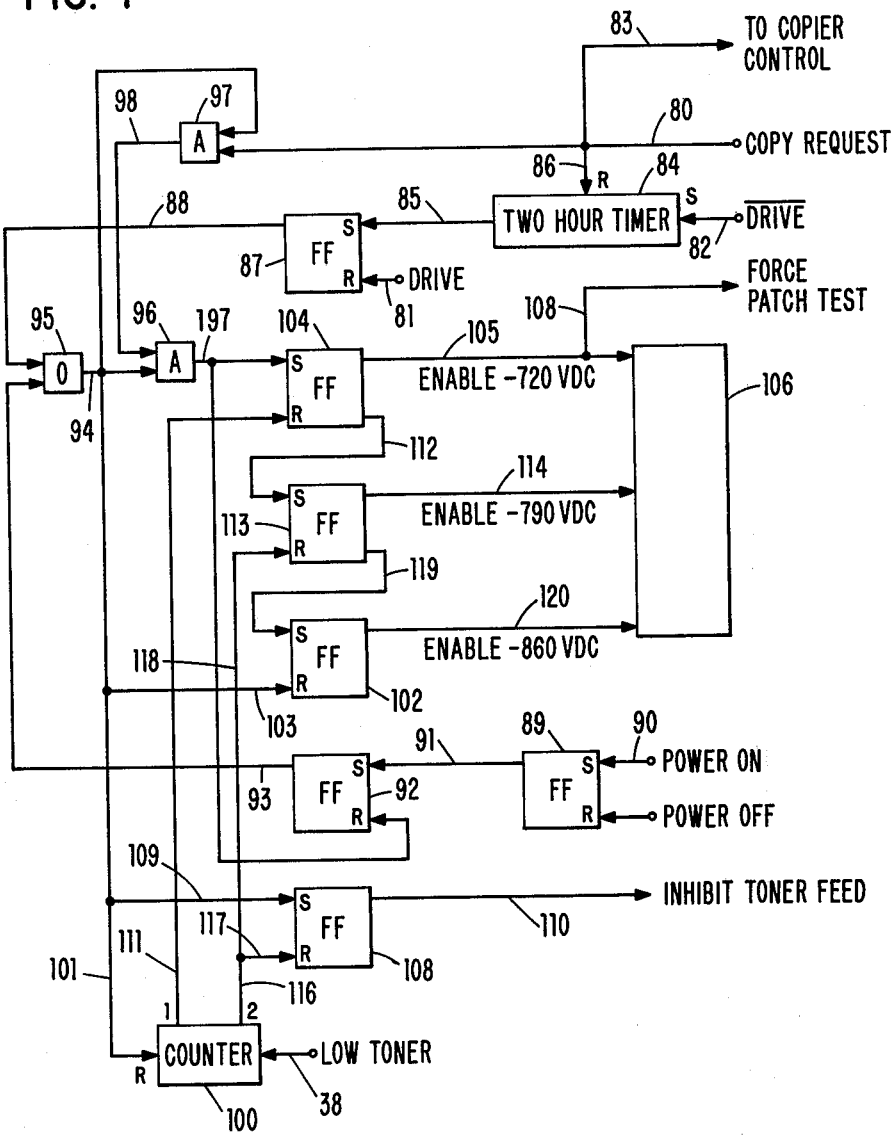
FIG. 4 is a showing of a discrete logic implementation of the present invention.

FIG. 4 is a discrete logic implementation of the invention of FIG. 3. In FIG. 4 copy request input line 80 is active so long as copier use is requested. For example, if a user requests one copy of one original document from the copier of FIG. 1, line 80 is active for only a short time. During this time, and as a result of line 80 being active, drive line 81 is also active, and not-drive line 82 is inactive. If a larger copy request is made, either by requesting more copies of one original document, or one or more copies of more than one original document, lines 80 and 81 are active, and line 82 is inactive for a longer time interval. An active signal on line 83 indicates to the copier's control means that the copy request has not come to an end as yet.

At the end of every copy request, line 82 becomes active, and two-hour timer 84 is enabled to begin its timing function. Only at the end of an uninterrupted copier-nonuse period of two hours does line 85 become active. When a copy request is made short of two hours of copier non-use, line 86 resets timer 84. Whenever line 85 makes an inactive-to-active transition, flip-flop 87 is set, and line 88 becomes active.

An active signal on line 88 indicates occurrence of the two-hour non-use critical event.

Turning now to the sensing of another critical event, flip-flop 89 is set by a power-off to power-on transition on line 90. This transition occurs when main power switch 39 of FIG. 1 is turned on. Subsequently, when this switch is turned off, flip-flop 89 is reset. When flip-flop 89 is set, its output line 91 makes an active-to-inactive transition, and flip-flop 92 is set. As a result, line 93 becomes active.

An active signal on line 93 indicates the occurrence of the copier off-to-on critical event.

An active input on either line 88 or line 93 causes line 94 to become active by virtue of operation of OR 95. Line 94, when active, provides one enabling input to AND's 96 and 97. AND 97 now awaits the occurrence of the next copy request, indicated by line 80 becoming active.

Active line 94 causes counter 100 (to be described) to be reset to zero by an active signal on line 101. Active line 94 causes flip-flop 102 (which was in a set state, as will be apparent) to be reset by the inactive-to-active transition on line 103. Active line 94 also causes flip-flop 108 to be set.

The apparatus of FIG. 4 has now detected the occurrence of a critical event, and is awaiting a copy request.

When this occurs, line 98 becomes active, AND 96 is enabled, and line 197 becomes active. An inactive-to-active transition on line 197 sets flip-flop 104, thus causing line 105 to become active. As a result, the power supply of FIG. 6, designated 106, is controlled to apply −720 VDC to the grid of FIG. 1's charging station 12. An inactive-to-active transition on line 197 resets flip-flop 92 (if the power off-to-on critical event is the one which in fact occurred), and line 93 becomes inactive.

If, however, timer 84 detected occurrence of the other critical event, as line 81 makes its inactive-to-active transition due to receipt of a copy request, and the copier begins to operate, flip-flop 87 is reset and line 88 becomes inactive.

In either event, output 94 of OR 95 now also becomes inactive. As a result, AND 97 is no longer responsive to subsequent copy requests which periodically occur during subsequent use of the copier.

The first copy run after the occurrence of a critical event has now been initiated. During that copy run, and only that copy run, active line 108 is operative to cause FIG. 2's toner concentration control apparatus to perform a patch density sample after only the first copy of this run. Thereafter, even though line 108 remains active, the frequency of patch density sensing is at the normal frequency, namely at the end of each copy request, or after n copies of a long copy request.

It will be remembered that the first copy request to occur after the occurrence of a critical event causes an inactive-to-active transition to occur at output 94 of OR 95. This transition is effective to set flip-flop 108 by way of line 109. This flip-flop, when set, inhibits the dispensing of toner from dispenser 31 to developing station 23, due to the active signal now on line 110. Output 38 of FIG. 2 is normally intended to effect such toner dispensing and to thereby maintain proper toner concentration within developer 23's toner-carrier mix.

As the copier continues to operate, either in this first copy request after a critical event, or in subsequent copy requests, output 38 of FIG. 2's toner concentration control means will issue a first-to-occur toner low signal 38. This first signal causes counter 100 to read "1". As a result, line 111 makes an inactive-to-active transition, and flip-flop 104 is reset. Resetting of this flip-flop causes its output line 112 to make an inactive-to-active transition, and flip-flop 113 is set. Line 114 now becomes active. As a result, photoconductor drum 11 of FIG. 1 is now subsequently charged to −790 VDC.

The copier now will execute all copy requests, and toner concentration control test cycles at a photoconductor voltage of −790 VDC.

Sometime thereafter, the second-to-occur toner low signal appears on conductor 38. Counter 100 now increments to "2". As a result, line 116 makes an inactive-to-active transition. This transition, on line 117, operates to reset flip-flop 108. As a result, line 110 becomes inactive and toner may now be dispensed to developing station 23. In addition, this same transition, on line 118, operates to reset flip-flop 113. Its output line 119 now makes an inactive-to-active transition, and flip-flop 102 is set.

With flip-flop 102 set, an active signal on line 120 enables power supply 106 to subsequently charge photoconductor drum 11 to its nominal working voltage of −860 VDC.

The copier now continues to operate in its normal manner until the next occurrence of a critical event, whereupon the above described closed-loop control of photoconductor charge sequences from −720 VDC, to −790 VDC, to −860 VDC will again occur.

Figure 5:
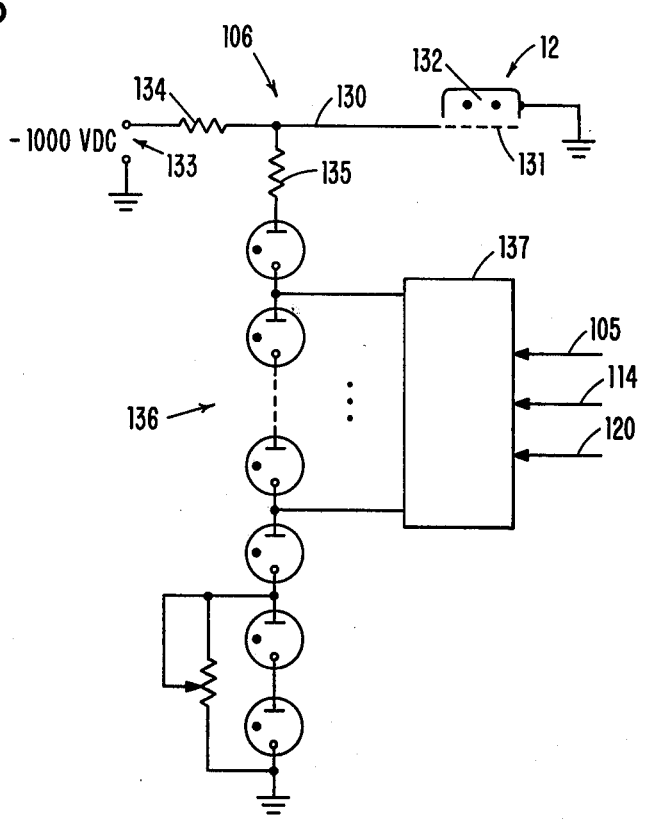
FIG. 5 shows FIG. 1's charging station and its control grid power supply.

FIG. 5 is an exemplary power supply circuit for effecting a change in the charging of photoconductor drum 11 by charging station 12. The voltage level of conductor 130 determines the voltage level of grid 131 associated with negative charge corona 132. Direct current power supply 133 supplies a series circuit comprising resistors 134 and 135, and eight series-connected voltage regulating tubes (VR's) 136. Transistor switching network 137 responds to the control signals present on lines 105, 114, 120 (originating at FIG. 4) to effect shorting of VR tubes so as to achieve the required negative charge of the photoconductor to −720 VDC, −790 VDC or −860 VDC.

The present invention produces a lower (i.e. less negative) photoconductor charge upon the occurrence of a critical event. If all other factors including toner concentration are assumed to remain constant, this lower charge would result in less dense toner at FIG. 2's test patch 32. However, the occurrence of such a critical event would, in the absence of the present invention, have resulted in too dense a toner with resulting poor copy quality and/or fuser wrap.

Another possibility which may occur is the somewhat unusual situation where, in fact, dispenser 31 has emptied of toner prior to the occurrence of such a critical event. In this event, and if the operator ignores the copier's signal light requesting that toner be added to replenisher 31, and instead continues to run a few thousand copies, which in fact can be done, then toner concentration will inherently be low prior to the occurrence of the critical event.

Subsequently, the occurrence of the critical event results in a lower photoconductor charge, and a lower toner density than normal on test patch 32. The accumulative effect of both low toner concentration and low photoconductor voltage causes FIG. 2's line 65 to become active, as described in said referenced applications. As will be apparent, this signal can be used to immediately control charging station 12 back to the nominal working value of −860 VDC without first going through the intermediate charge level of −790 VDC.

Those skilled in the art may elect to implement the present invention with a variety of means other than that of FIG. 4. The present invention may also be implemented by microcomputer control.

More specifically, the microcomputer may preferably be of the type disclosed in commonly assigned U.S. Pat. No. 4,086,658, incorporated herein by reference.

This patent discloses the microcomputer and its instruction repertoire. It is within the skill of the art to which this invention pertains to write a program implementing the invention of FIG. 3 and/or FIG. 4. Using this instruction repertoire, a source program is written, the program is converted to object data or machine language by an assembler, and the microcomputer is loaded with this data in order to effect control of FIGS. 1 and 2 to achieve the invention of FIGS. 3 and 4.

Figure 8:
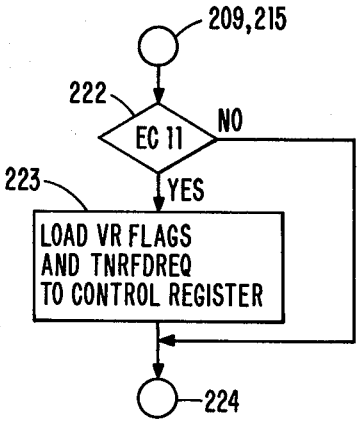
FIGS. 6, 7 and 8 are program flow chart segments which implement the present invention by the use of a microcomputer.
Figure 7:
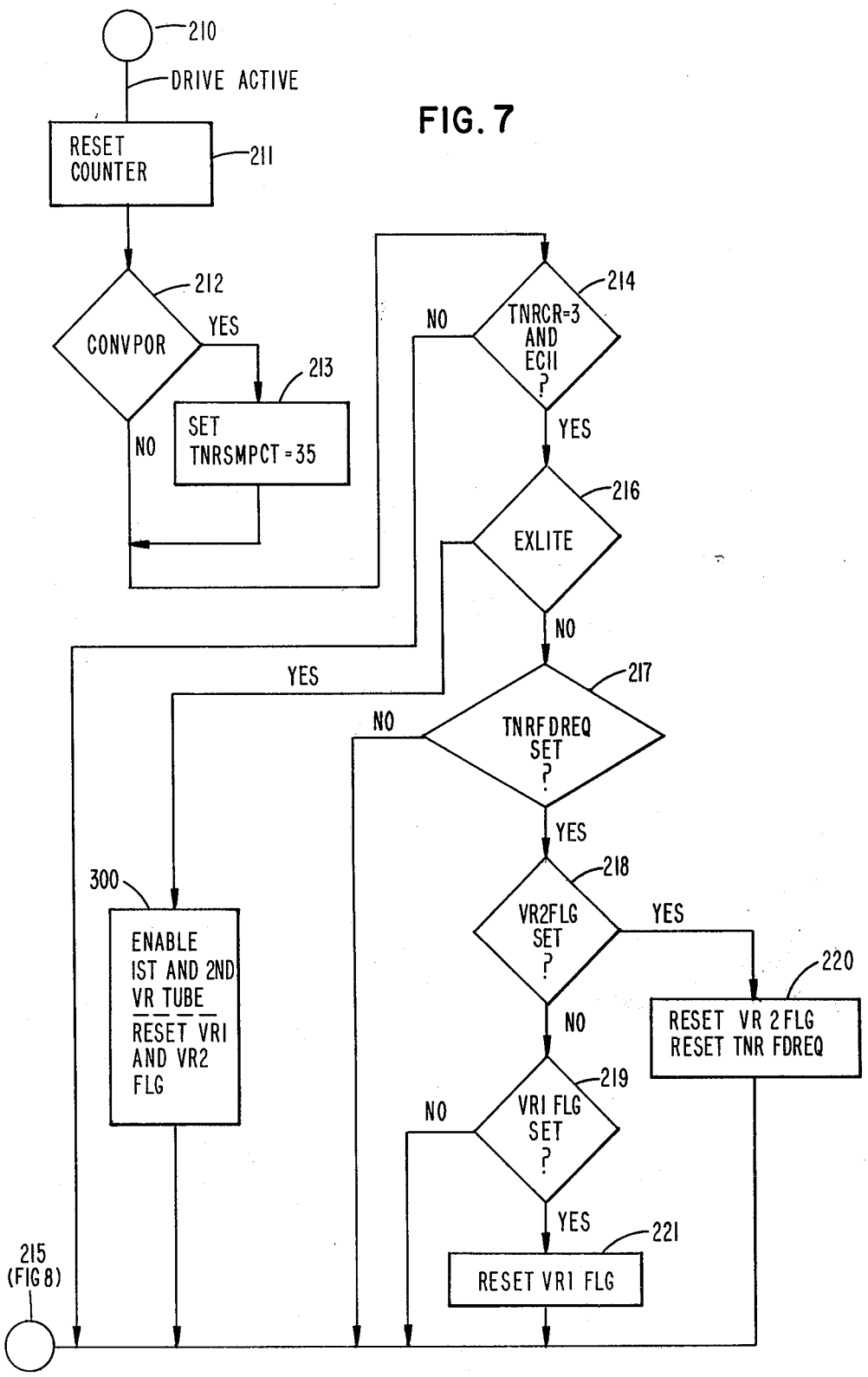

FIGS. 6, 7 and 8 are flow charts of segments of such a program. FIG. 6 is the segment which detects occurrence of the two critical events above described. FIG. 7 is the segment which operates to selectively feed toner from dispenser 31, and/or to step the photoconductor voltage back to its working magnitude, during subsequent copy runs, if a critical event has occurred. FIG. 8 is the segment which operates to effect control of FIG. 1's toner dispenser 31, and/or FIG. 5's VR tubes, if such a critical event has occurred, and as called for by flags which are set by FIGS. 6 and 7.

The following table defines the mnemonics used in FIGS. 6, 7 and 8:

TABLE

| | |
|---|---|
| DRIVE | YES SO LONG AS COPIER MAIN MOTOR IS ENERGIZED |
| PORFLG | RESET FOR FIRST POLLING LOOP AFTER COPIER OFF-TO-ON ONLY |
| CONVPOR | YES FOR FIRST COPY AFTER CRITICAL EVENT |
| TNRSMPCT | COUNTER WHICH IS INCREMENTED AS COPIES ARE MADE. AFTER COUNT = 35, FIG. 2 OPERATES TO CHECK TONER CONCENTRATION OF PATCH 32 |
| TNRCR1-5 | ACTIVE STATE FOR THE 2½ REVOLUTIONS OF PHOTOCONDUCTOR DRUM 11 DURING WHICH THE TONER CONCENTRATION DEVICE OF FIG. 2 ACCOMPLISHES ONE TEST CYCLE |
| EC1-16 | SIXTEEN DISCRETE AND DIFFERENT DRUM POSITIONS FOR EACH ½ REVOLUTION OF PHOTOCONDUCTOR DRUM 11 |
| EXLITE | YES IF ACTIVE SIGNAL ON FIG 2'S CONDUCTOR 65 |
| TNRFDREQ | SET IF ACTIVE SIGNAL ON FIG. 2'S CONDUCTOR 38 |

With reference to FIG. 6, the program entry point is identified as 200. Portion 201 of the program determines if the copier is operating. If it is not, portion 202 tests to determine if the copier has experienced an off-to-on event since the last polling loop by the microcomputer. A "yes" condition signals the occurrence of this particular critical event, and two VR tubes of FIG. 5 are disabled, as at 203, thus initializing a photoconductor charge state of −720 VDC for a subsequent copy request. Two flags are set, namely VR1FLG and VR2FLG. These two flags, when set, will be loaded into a control register (223, FIG. 8) and will effect this VR control of FIG. 5. Once this occurs, portion 205 sets PORFLG. For all subsequent polling loops, 202 in No. Subsequent polling loops now proceed to portion 204, until such time as a copy request is received and DRIVE becomes active.

Portions 204, 207, 208 test to see if a two-hour non-use period has occurred. A "yes" of portion 207 indicates such an occurrence, and portion 208 operates to control FIG. 5's VR tubes as does portion 203, above described.

Exit point 209 is the end of the segment.

When DRIVE becomes active, FIG. 6 entry point 210 enters the FIG. 7 segment. The first function accomplished by the program is to reset the counter which measures the copier's non-use time period, i.e.

portion 211. Portion 212 now tests to see if this is the first copy after the occurrence of a critical event. If it is, portion 213 sets the counter which controls the frequency of operation of FIG. 2 toner concentration control means such that it will operate immediately after the first copy.

The next portion 214 operates to detect (1) a dummy cycle of the copier indicative of test cycle operation of FIG. 2, and (2) the proper position of drum 11 such that patch 31 is in the position shown in FIG. 2. If a test is not being made, the segment exits to 215 (FIG. 8). If a test is being made, portion 216 tests line 65 (FIG. 2) to determine if the test results were "toner extra low". If the results are "yes", the segment exits to 215 by way of function 300. Function 300 is the above-described means by which FIG. 2's line 65, when active, enables immediate control of charging station 12 back to the nominal working value of −860 VDC rather than going through the intermediate charge level. If toner extra-low has not been experienced (remembering that this is an unusual circumstance usually associated with depletion of toner in dispenser 31, as above described), then portion 217 tests line 38 (FIG. 2) to determine if operation of FIG. 2's toner concentration control means has generated a signal on line 36. Failure to generate such a signal causes an exit to 215. Eventually, however, copier operation produces a need to add toner, i.e. an active signal on line 38 (i.e. TNRFDREQ is set), and portions 218 and 219 then test the VR flags which were set in FIG. 6's portion 203 or 208 to see if this particular copier run is being made at other than a nominal −860 VDC working voltage. If it is, portions 220 and 221 effect a change of the voltage to −790 VDC or −860 VDC, respectively, in a closed-loop manner in accordance with operation of FIG. 2.

Exit point 215 of FIG. 7 enters FIG. 8, as does exit point 209 of FIG. 6. Portion 222 is operative at a particular position in each half cycle of photoconductor drum 11 to load FIG. 6's VR flags to a control register to be used in copier control by the microcomputer. If set, these flags will control FIG. 5's VR tubes to effect a photoconductor charge of −790 VDC or −720 VDC. In addition, a toner feed request may be indicated by TNRFDREQ being set. This also is loaded to the control register by portion 223.

Point 224 is the exit of the FIGS. 6, 7, 8 segment.

A copier control segment of the program will test the control register, and will control FIG. 5 and the photoconductor's charge voltage as required for the copier's particular operating state.

By way of example, the following program listing implements FIG. 6, and comprises a teaching whereby FIGS. 7 and 8, as well as copier control functions, can be implemented by one of skill in the art to which the present application pertains.

PROGRAM LISTING

```
                                IF-DRIVE
        TPB  PSB21,DRIVE
        BZ   ECDC25                                  (FIG. 6, 201 = NO)
                                THEN
ECDC25                                               (FIG. 6, 202)
                                IF PORFLG RESET      (FIG. 6, 202 = YES)
        SRG  ECCARDRG
        LR   FLAGAREG
        TS   PORFLG
        BNZ  ECDC35                                  (FIG. 6, 202 = NO)
                                THEN, DISABLE 2VR TUBES
        LR   FLAGAREG
        TRA
        OI   O'60'
        TRA
                                SET PORFLG
        TS   PORFLG
        STR  FLAGAREG
        B    ECDC40                                  (FIG 6, 209)
                                ELSE
ECDC35                                               (FIG. 6, 202 = NO)
                                INCREMENT COUNTER
        LR   COUNTER
        AI
        STR  COUNTER
                                IF COUNTER = 120 MIN.
        NI   X'OF'
        CI   X'OC'
        BNE  ECDC40                                  (FIG. 6, 207 = NO)
                                THEN, DISABLE 2VR TUBES
        LR   FLAGAREG
        TRA
        OI   0'60°
        TR
ECDC40  DC   *                                       (FIG 8, 209/215)
                                ENDIF;
                                ENDIF;
B0979034
```

While the invention has been particularly shown and described with reference to preferred embodiments thereof, it will be understood by those skilled in the art that various changes in form and details may be made therein without departing from the spirit and scope of the invention.

What is claimed is:

1. A method of controlling a xerographic device so as to maintain consistent copy toner density, comprising:

sensing the toner density appearing on a photoconductor and adding toner to a developer when a low toner density is sensed;

sensing an event which will normally result in a copy image which is excessively dense;

reducing the magnitude of photoconductor charge from a nominal working magnitude, and inhibiting said adding of toner to the developer, as a result of sensing such an event;

sensing the toner density subsequently appearing on the photoconductor which is charged to the reduced magnitude;

increasing the magnitude of photoconductor charge toward the working magnitude when a low toner density is subsequently sensed; and subsequently enabling said adding of toner to the developer only when the magnitude of photoconductor charge has been increased to a predetermined magnitude, and a low toner density has been sensed.

2. The method of claim 1 including the step of sensing toner density once every n copies.

3. The method of claim 2 wherein said event is a copier off-to-on event.

4. The method of claim 3 wherein a second said event is a given period of copier non-use.

5. The method of claim 2 wherein said event is a given period of copier non-use.

6. The method of claim 5 wherein said period of copier non-use is an uninterrupted period of non-use.

7. In a xerographic device wherein a reusable photoconductor is normally charged to a working voltage, an electrostatic latent image is then formed thereon, said image is then toned as said image passes through a developer, and wherein a toner concentration control means periodically operates to form a test pattern charge on said photoconductor prior to development thereof, and thereafter senses light reflected off the toned test pattern, the light reflection varying as an inverse function of toner density of said test pattern, said toner concentration control means being operative to add toner to said developer to maintain a given toner concentration, the improvement comprising:

means responsive to the occurrence of a critical event, known to have a transient tendency to result in too dense toner on said test pattern with no actual change in toner concentration, and operable upon the occurrence of such an event to reduce the magnitude of photoconductor charge voltage, so as to reduce the density of toner on the photoconductor's image;

further means responsive to the occurrence of said critical event, operative to inhibit the adding of toner to said developer at least during the initial portion of said transient tendency; and further means responsive to the occurrence of said critical event and controlled by said toner concentration control means operable to increase the magnitude of the photoconductor charge as the density of toner on the photoconductor's image reduces during dissipation of said tendency, and to enable the adding of toner to said developer at least when said tendency has been dissipated.

8. The device of claim 7 wherein the frequency of periodic operation of said toner concentration control means is increased during the interval of said transient tendency.

9. An electrophotographic process device including a photoconductor which is cyclically subjected to a charging station whereat said photoconductor receives a working charge, an image-forming station, and a developing station having a toner-carrier mix and a toner dispenser to dispense toner to said mix as toner is consumed, including:

toner concentration control means cooperating with a portion of said photoconductor after said portion is subjected to said developing station and operable to sense a low toner density on said portion, said toner concentration control means having an output normally operatively connected to said toner dispenser to effect the addition of toner to said toner-carrier mix upon the sensing of a low toner density;

means responsive to the occurrence of a critical event whose occurrence is likely to result in a transient period of abnormally high photoconductor toner density with no actual change in toner concentration;

first means controlled by said responsive means, upon sensing such an occurrence, and operative to control said charging station in a manner to alter the photoconductor's charge during said transient period so as to reduce the toning of its image by the developing station, and to inhibit the dispensing of toner during at least a portion of said transient period; and second means controlled by said toner concentration control means, upon operation of said first means, operative during said transient period to alter the photoconductor's charge in a manner opposite to said first means as said toner concentration control means periodically senses a low photoconductor toner density as said transient period expires, and to thereafter enable the dispensing of toner.

10. In a copier having a reusable photoconductor which is first charged to a working voltage and then developed by a carrier/toner mix to produce a visible image, wherein the copier exhibits a transient propensity to produce copies having more toner than normal thereon after the occurrence of a critical event, the improvement comprising:

first means operable to detect the occurrence of a critical event;

second means controlled by said first means and operable to alter the voltage magnitude of photoconductor charge in a direction to normally produce less toner in said visible image when a critical event is detected;

closed-loop control means controlled by said second means and operable to monitor the toner in said visible image during the interval of said transient propensity and to effect control of the magnitude of photoconductor charge back to said working voltage; and further means operable to normally add toner to said mix as a result of operation of said closed-loop control means, said further means being controlled by said first means to be inoperative during at least a part of the interval of said transient propensity and to be operative thereafter.

* * * * *